US010626346B2

(12) United States Patent
Emo

(10) Patent No.: US 10,626,346 B2
(45) Date of Patent: Apr. 21, 2020

(54) ORGANIC BASED EXTRACTION SYSTEM

(71) Applicant: Jayson Emo, Denver, CO (US)

(72) Inventor: Jayson Emo, Denver, CO (US)

( * ) Notice: Subject to any disclaimer, the term of this patent is extended or adjusted under 35 U.S.C. 154(b) by 0 days.

(21) Appl. No.: 16/130,334

(22) Filed: Sep. 13, 2018

(65) Prior Publication Data

US 2019/0010421 A1 Jan. 10, 2019

Related U.S. Application Data

(63) Continuation of application No. 14/513,901, filed on Oct. 14, 2014, now Pat. No. 10,106,760.

(60) Provisional application No. 61/890,529, filed on Oct. 14, 2013.

(51) Int. Cl.
*C11B 9/02* (2006.01)

(52) U.S. Cl.
CPC ..... *C11B 9/025* (2013.01)

(58) Field of Classification Search
CPC ..... C11B 9/025
USPC ..... 554/20
See application file for complete search history.

(56) References Cited

U.S. PATENT DOCUMENTS 2,414,418 A * 1/1947 Lofton, Jr. ..... C07C 45/80 568/324
10,106,760 B2 * 10/2018 Emo ..... C11B 9/025
2011/0133120 A1 * 6/2011 McGhee ..... B01D 11/0219 252/182.12

* cited by examiner

*Primary Examiner* — Deborah D Carr
(74) *Attorney, Agent, or Firm* — Knobbe, Martens, Olson & Bear, LLP

(57) ABSTRACT

An organic based extraction system is described. Embodiments of the extraction system include a first vessel, a second vessel, a third vessel, a pump, and a plurality of sight lenses. Generally, each of the vessels and the pump can be set up to form a closed loop system adapted to recover and reuse a solvent. A fluid flow from the first vessel to the second vessel, from the second vessel to the third vessel, from the third vessel to the pump, and from the pump back to the first vessel can be implemented. Typically, an extract from organic matter can be recovered in the third vessel. In one embodiment, the plurality of sight lenses can be implemented to determine if more solvent is needed and to check the extract while an extraction process is running.

29 Claims, 6 Drawing Sheets

ORGANIC BASED EXTRACTION SYSTEM

CROSS-REFERENCE TO RELATED APPLICATION

This application claims the benefit of U.S. Provisional Application No. 61/890,529, filed Oct. 14, 2013.

BACKGROUND

Solvent extraction is one method used to separate a desired compound from a substance by using a solvent. Solvent extraction relies on solubility variations of different compounds in extracting the desired compound. In most cases, the compound to be extracted is dissolved in a liquid, along with other compounds of the primary substance, and a liquid solvent is used for the extraction.

Current methods of obtaining desired compounds by solvent extraction are typically dangerous and require a user to check after the extraction process has finished to determine if enough solvent was being used and if the extract burned. Currently, there is no means for checking the extract in the recovery container and/or checking the solvent/extract mixture to see if more solvent is needed while the solvent extraction process is being carried out.

As such, a system including means for visually checking the extract and solvent/extract mixture while the extraction process is running is needed.

DETAILED DESCRIPTION

Figure 1:
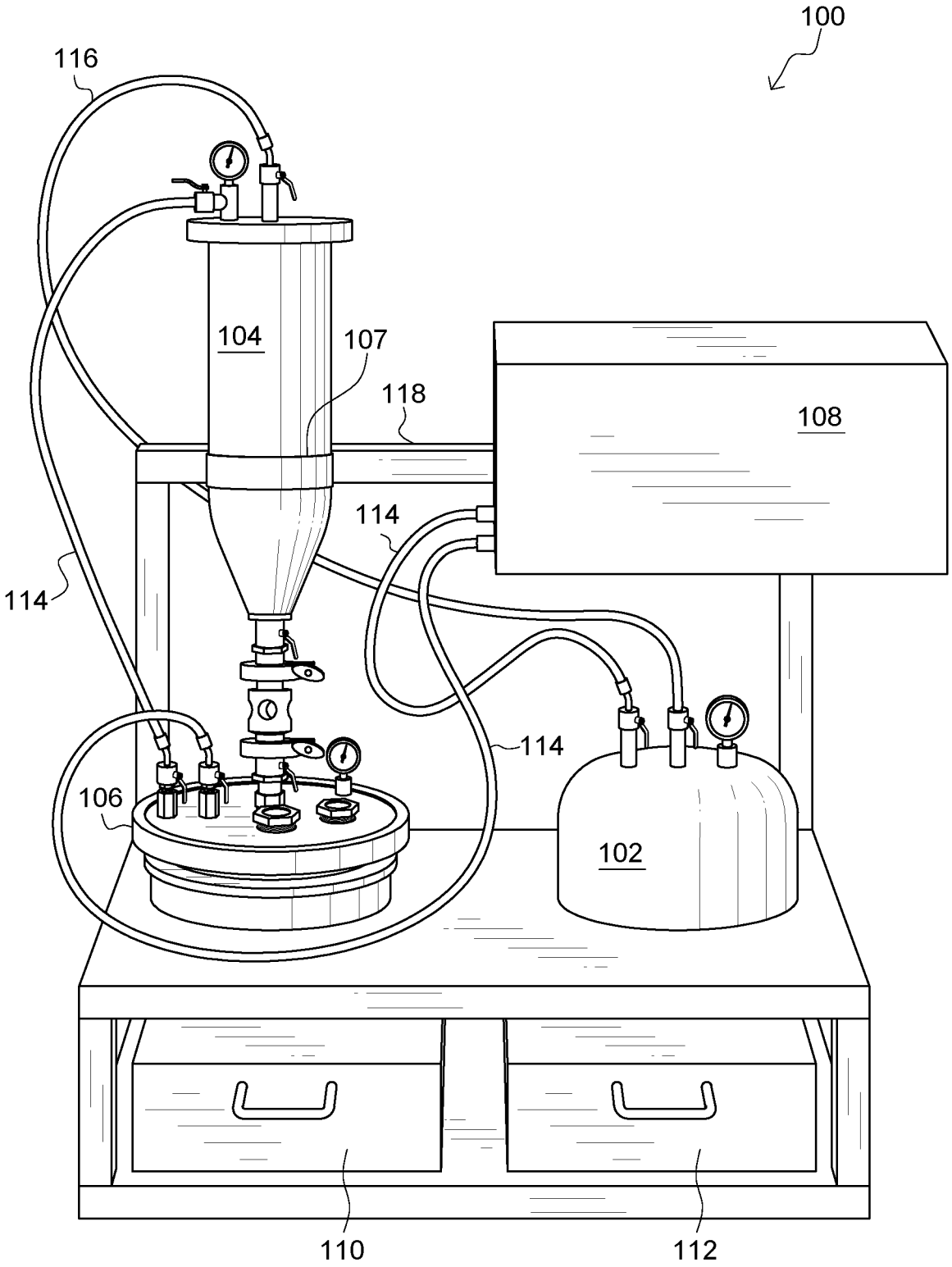
FIG. 1 is a perspective view of an organic based extraction system according to one embodiment of the present invention.

Embodiments of the present invention include an organic based extraction system. In one embodiment, the system can include a pump, a first vessel, a second vessel, a third vessel, one or more gas lines, a liquid line, a heating container, and a cooling container. Generally, each of the components of the system can be coupled to a rack. In a typical implementation, the organic based extraction system can be a closed loop system where a solvent is recovered and reused.

In one embodiment, the first vessel can be a delivery vessel adapted to hold a solvent. Typically, the solvent can be an organic solvent that is a gas at room temperature. By pressurizing the first vessel, the solvent can be contained in a liquid state. The second vessel generally has a tapered end and includes a filter near a bottom portion of the vessel. The tapered vessel can be adapted to hold organic matter. In one embodiment, the tapered vessel can include a manifold adapted to distribute the solvent equally about the tapered vessel. The third vessel can be a depository vessel adapted to hold extract of the organic matter and the solvent.

In some embodiments, the heating container can include a heating element. Generally, the heating container can be filled with water. The heating element can then be implemented to indirectly heat the water in the heating container. To cool the delivery vessel, the cooling container can be filled with chilled water. For instance, ice water can be added to the cooling container. It is to be appreciated that other means of cooling the water in the cooling container can be implemented. Typically, the third vessel can be adapted to fit inside the heating container and the first vessel can be adapted to fit inside the cooling container.

Generally, the first vessel can be cooled to lower the amount of pressure needed to keep the solvent a liquid. For instance, the solvent can remain a liquid at lower pressures if the temperature of the solvent is also lowered. Conversely, the third vessel can be heated to heat the solvent and cause the solvent to transform from a liquid phase to a gaseous and/or vapor phase.

In one embodiment, the organic based extraction system can include a burp line. The burp line can be implemented to equalize pressure preventing an uneven running of solvents due to back pressure. Typically, the burp line can be connected between the second vessel and the third vessel. For instance, solvent built up in the third vessel can be returned to the second vessel by the burp line.

In one embodiment, the first vessel, the second vessel, and the third vessel can each be manufactured from electropolished stainless steel. Generally, the vessels can be manufactured from electropolished stainless steel to provide a smoother surface for improved vacuum pressures, outgassing rates, and pumping speed.

In one embodiment, the organic based extraction system can be implemented to extract hash oil from *cannabis*. Hash oil is a *cannabis* product obtained by separating resins from *cannabis* buds. One example process for obtaining hash oil includes passing a liquid solvent through the second vessel filled with *cannabis* plant matter. As the solvent passes through the second vessel and interacts with the *cannabis* plant matter, resins can be trapped in the liquid solvent. As the solvent and resins exit the second vessel, the mixture can be recovered in the third vessel. The resin can then be separated from the solvent and recovered. For instance, the third vessel can be heated to transform the liquid solvent into a gaseous/vapor phase and returned to the first vessel. It is to be appreciated that the organic based extraction system can be implemented to extract a variety of compounds in addition to hash oil.

Terminology

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive; rather the term is inclusive, meaning either or both.

References in the specification to "one embodiment", "an embodiment", "another embodiment, "a preferred embodiment", "an alternative embodiment", "one variation", "a variation" and similar phrases mean that a particular feature, structure, or characteristic described in connection with the embodiment or variation, is included in at least an embodiment or variation of the invention. The phrase "in one embodiment", "in one variation" or similar phrases, as used in various places in the specification, are not necessarily meant to refer to the same embodiment or the same variation.

The term "couple" or "coupled" as used in this specification and appended claims refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object resides between those identified as being directly coupled.

The term "approximately," as used in this specification and appended claims, refers to plus or minus 10% of the value given.

The term "about," as used in this specification and appended claims, refers to plus or minus 20% of the value given.

The terms "generally" and "substantially," as used in this specification and appended claims, mean mostly, or for the most part.

Directional and/or relationary terms such as, but not limited to, left, right, nadir, apex, top, bottom, vertical, horizontal, back, front and lateral are relative to each other and are dependent on the specific orientation of a applicable element or article, and are used accordingly to aid in the description of the various embodiments and are not necessarily intended to be construed as limiting.

The term "organic matter," as used in this specification and appended claims, refers to matter that is composed of organic compounds. For instance, organic compounds can be found in plants including, but not limited to, *cannabis*, soybean, and garlic.

An Embodiment of an Organic Based Extraction System

Referring to FIG. 1, a detailed diagram of an embodiment 100 showing an organic based extraction system, hereinafter OBE system, is illustrated. Generally, the OBE system 100 can be implemented to collect extract from organic matter.

As shown in FIG. 1, the OBE system 100 can include a first vessel 102, a second vessel 104, a third vessel 106, a pump 108, a heating container 110, a cooling container 112, one or more gas lines 114, and a liquid line 116.

In one embodiment, the OBE system 100 can be assembled together on a mounting structure 118. For instance, the mounting structure 118 can be a custom rack adapted to hold each component of the OBE system 100. In one example, the mounting structure 118 can be a cart, as shown in FIG. 1. The first vessel 102, the second vessel 104, the third vessel 106, the pump 108, the heating container 110, the cooling container 112, the gas lines 114, and the liquid line 116 are shown assembled on the mounting structure 118 in FIG. 1.

Figure 2A:
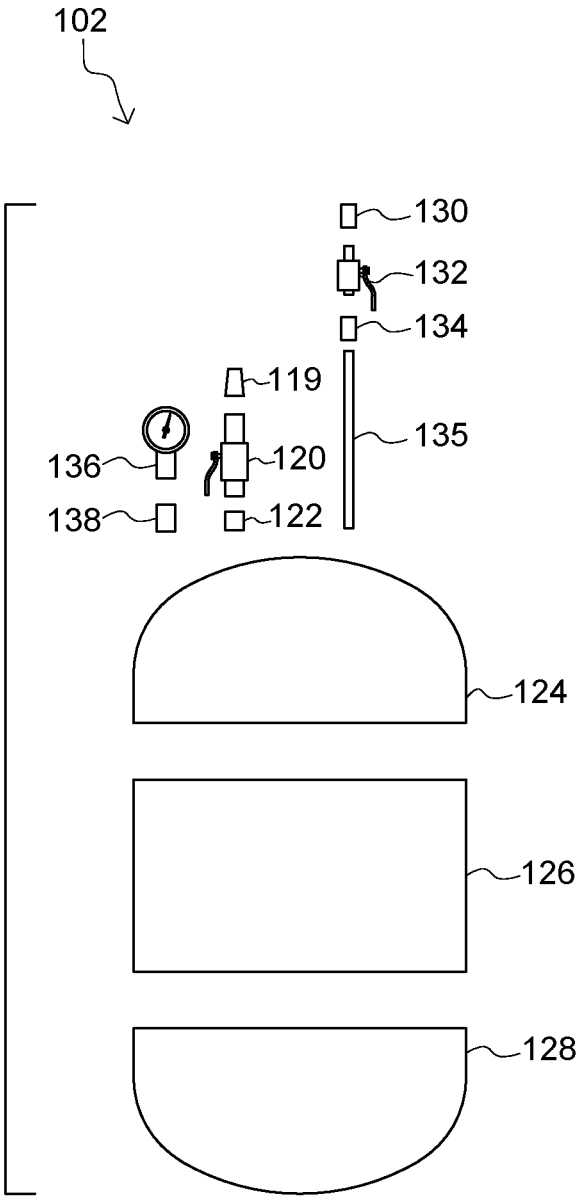
FIG. 2A is an exploded front view of a delivery vessel according to one embodiment of the present invention.

Referring to FIG. 2A, an exploded view of the first vessel 102 is illustrated. Generally, the first vessel 102 can be implemented as a delivery vessel adapted to hold a solvent. In one instance, the delivery vessel 102 can be implemented to hold a solvent under high pressure. As shown, the delivery vessel 102 can include a plurality of components. In one embodiment, the delivery vessel 102 can include a first quick connect 119, a first shutoff valve 120, a first collar 122, a first bowl 124, a pipe 126, a second bowl 128, a second quick connect 130, a second shutoff valve 132, a second collar 134, a pressure relief valve 136, and a third collar 138.

In some embodiments, the delivery vessel 102 can include a dip tube 135 coupled to the second collar 134. The dip tube 135 can be adapted to pull solvent from a bottom portion of the delivery vessel 102.

Figure 2B:
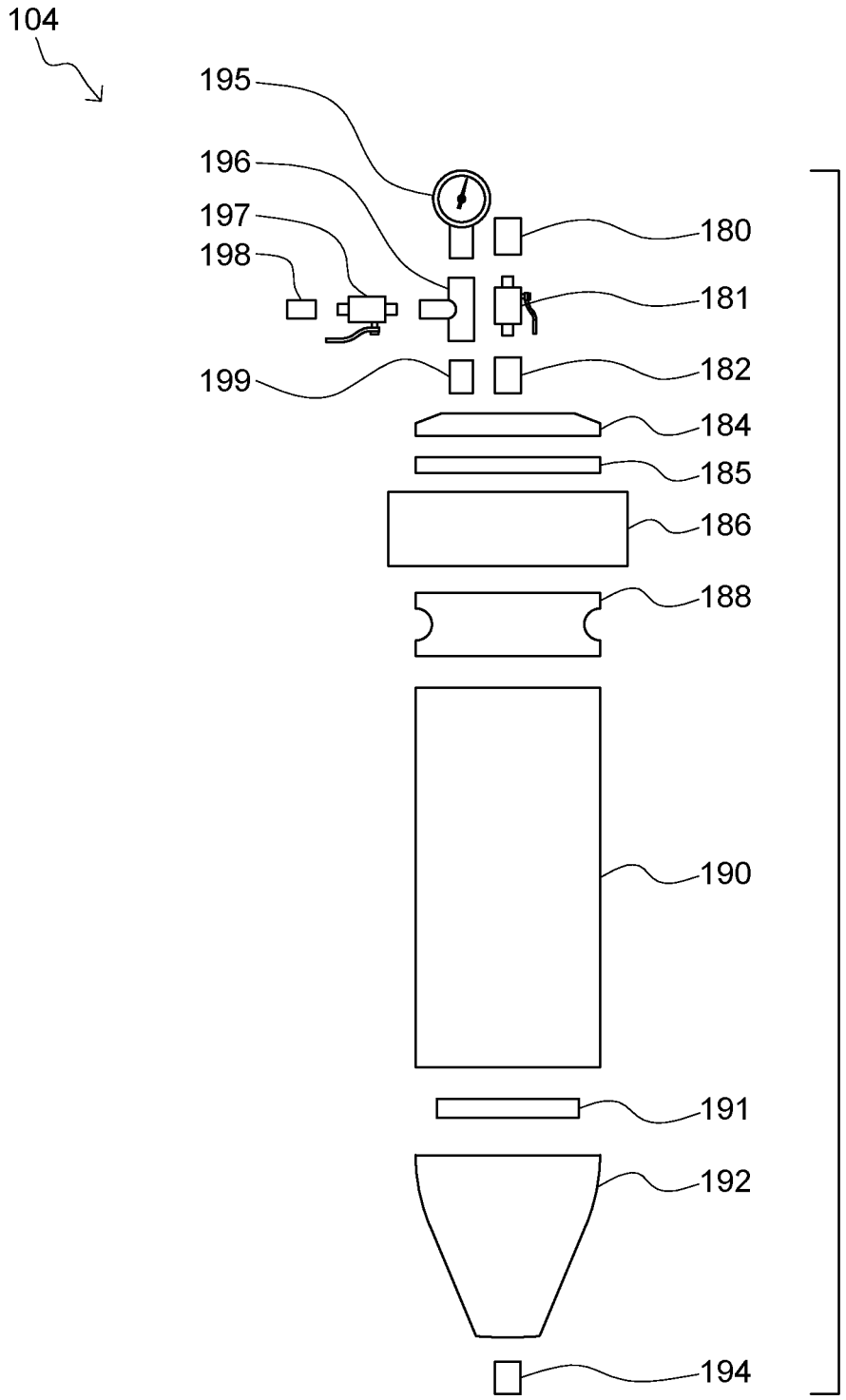
FIG. 2B is an exploded front view of a tapered vessel according to one embodiment of the present invention.

Referring to FIG. 2B, an exploded view of the second vessel 104 is illustrated. The second vessel 104 can generally be implemented as a tapered vessel adapted to hold the organic matter. Typically, the solvent can be transferred to the tapered vessel 104 from the delivery vessel 102 to interact with the organic matter. As shown, the tapered vessel 104 can include a first quick connect 180, a first shutoff valve 181, a first collar 182, a top plate 184, a manifold 185, a clamp 186, a flange 188, a pipe 190, a filter 191, a conical pipe 192, a second collar 194, a pressure relief valve 195, a T-connect 196, a second shutoff valve 197, a second quick connect 198, and a third collar 199.

Generally, the tapered vessel 104 can be oriented in a vertical direction with the tapered end down. In the vertical orientation, gravity can be implemented to move the solvent through the tapered vessel 104. The tapered vessel 104 can generally include the filter 191 near a bottom portion of the tapered vessel 104 that can be adapted to filter the solvent and organic matter. Typically, the top plate 184 of the tapered vessel 104 can be opened to have organic matter inserted into the tapered vessel 104. In one embodiment, the tapered vessel 104 can be adapted to hold up to 1000 grams of organic matter.

In one embodiment, an attachment structure 107 can be implemented to couple the tapered vessel 104 to the rack 118. For instance, the attachment structure 107 can be a hook and loop patch coupled to the rack 118. As such, the tapered vessel 104 can be easily removed for cleaning when needed. The top plate 184 and the clamp 186 can be adapted to seal the tapered vessel 104 from the atmosphere. As shown, the top plate 184 can include the first collar 182, the first shutoff valve 181, and the first quick connect 180 to couple to the liquid line 116.

Generally, the tapered vessel 104 can include the manifold 185 to distribute the solvent equally across a diameter of the tapered vessel 104. As shown, the manifold 185 can generally be located near a top portion of the tapered vessel 104. The manifold 185 can generally be in-line with the first collar 182 of the tapered vessel 104. In a typical implementation, as solvent enters the tapered vessel 104, the solvent can be spread evenly about a circumference of the tapered vessel 104.

Near a bottom portion of the tapered vessel 104, the filter 191 can be implemented to screen particulates from entering the depository vessel 106.

Figure 2C:
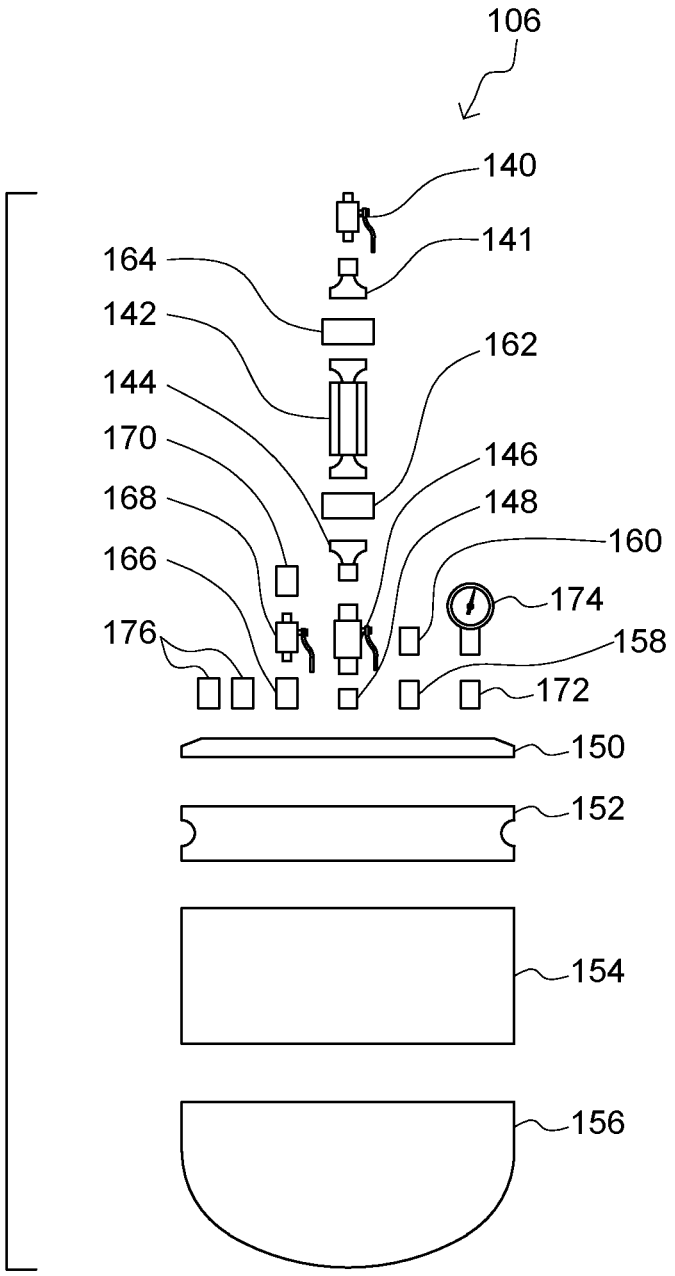
FIG. 2C is an exploded front view of a depository vessel according to one embodiment of the present invention.

Referring to FIG. 2C, an exploded view of the third vessel 106 is illustrated. The third vessel 106 can be implemented as a depository vessel adapted to receive extract trapped in the solvent interacting with the organic matter. As shown, the depository vessel 106 can include a first shutoff valve 140, a first flange 141, a sight lens tube 142, a second flange 144, a second shutoff valve 146, a first collar 148, a top plate 150, a third flange 152, a pipe 154, a bowl 156, a second collar 158, a first quick connect 160, a first clamp 162, a second clamp 164, a third collar 166, a third shutoff valve 168, a second quick connect 170, a fourth collar 172, a pressure relief valve 174, and a plurality of sight lenses 176.

As shown, the depository vessel 106 can include the sight lens tube 142 and the plurality of sight lenses 176. The sight lens tube 142 can be implemented to allow a user to view the transfer of the solvent and resulting organic extract from the tapered vessel 104 to the depository vessel 106. Typically, a user can look through the sight lens tube 142 to determine if more solvent is needed. For instance, an opacity of the substance viewed in the pipe can allow a user to determine if more or less solvent is needed. In one example, if a user views that the mixture flowing through the sight lens tube 142 is transparent, the user can determine that all of the targeted compound has been extracted. In another example, if the mixture is substantially opaque, the user may determine that more solvent may be needed. Typically, the user can continuously monitor the mixture during the extraction process.

The plurality of sight lenses 176 can generally be located on the top plate 150 of the depository vessel 106. The plurality of sight lenses 176 can be implemented to allow a user to see into the depository vessel 106. Generally, at least two of the plurality of sight lenses can be located proximate to each other to allow a user to flash light into one of the lenses and view into the depository vessel 106 from the other lens. It is to be appreciated that the lenses can be manufactured from suitable materials to withstand pressure requirements of the system. For example, the sight lenses 176 can be socket head sight glasses.

Figure 3:
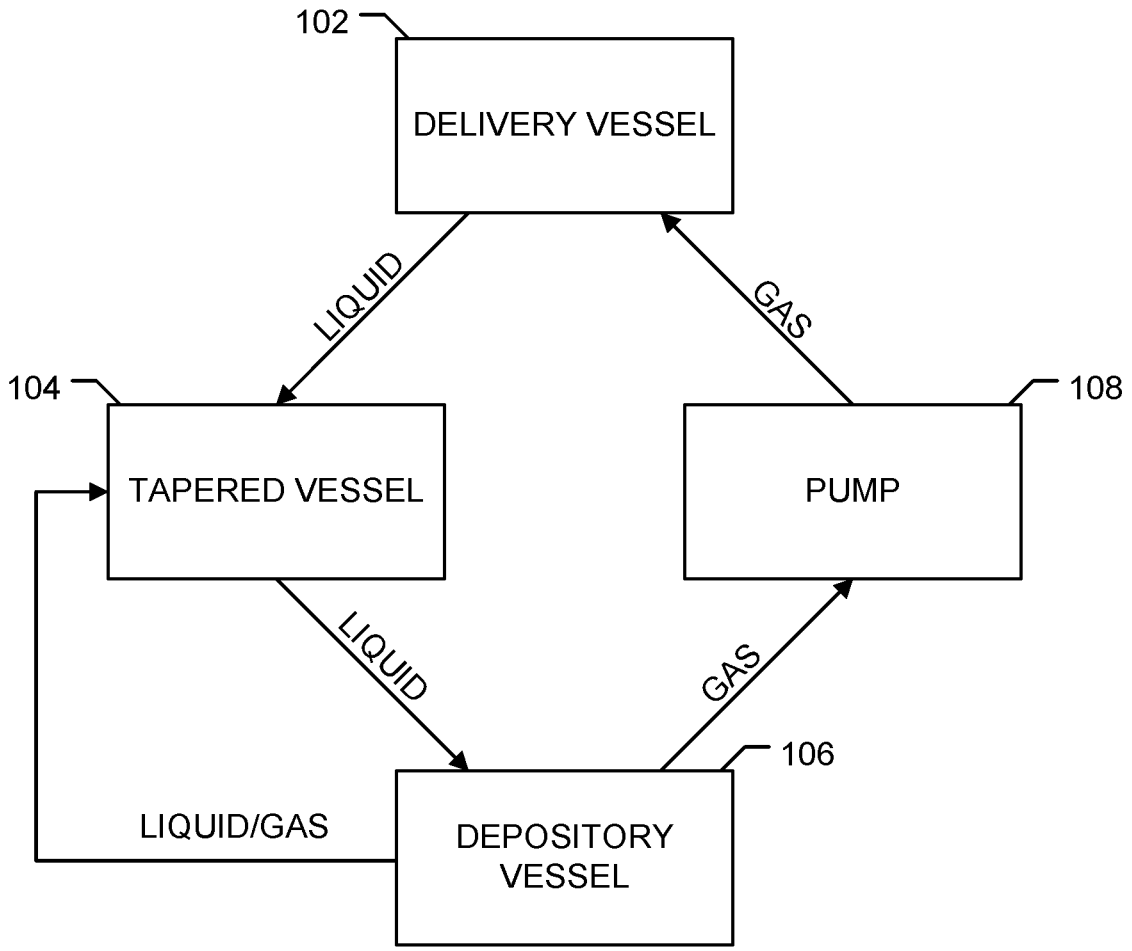
FIG. 3 is a block flow chart of an organic based extraction system according to one embodiment of the present invention.

Referring to FIG. 3, a fluid flow block diagram of the OBE system 100 is illustrated. In a typical implementation, the delivery vessel 102 can be fluidly connected to the tapered vessel 104 and the pump 108. The tapered vessel 104 can be fluidly connected to the delivery vessel 102 and the depository vessel 106. The depository vessel 106 can be fluidly connected to the tapered vessel 104 and the pump 108. As shown in FIG. 3, a typical flow patter includes a liquid solvent being transferred from the delivery vessel 102 to the tapered vessel 104, the liquid solvent from the tapered vessel 104 to the depository vessel 106, the solvent in gaseous state from the depository vessel 106 to the pump 108, and the gas solvent from the pump 108 back to the delivery vessel 108. In some instances, solvent from the depository vessel 106 can be returned to the tapered vessel 104.

In a typical implementation, the plurality of shutoff valves included with the vessels 102, 104, 106 can be used to control the flow of the solvent from the delivery vessel 102 to the tapered vessel 104, from the tapered vessel 104 to the depository vessel 106, from the depository vessel 106 to the pump 108, and from the pump 108 to the delivery vessel 102. To transfer the solvent from the delivery vessel 102 to the tapered vessel 104, the shutoff valves connected with the liquid line 116 can be opened. Typically, a user can control an amount of solvent being transferred by opening and/or closing the valves connected to the liquid line 116.

As shown in FIG. 1, one of the plurality of gas lines 114 can connect the delivery vessel 102 to the pump 108 and another gas line can connect the depository vessel 106 to the pump 108. It is to be appreciated that the gas lines 114 can be implemented to create an approximate vacuum in the delivery vessel 102, the depository vessel 106, and the tapered vessel 104. In one embodiment, the plurality of gas lines 114 and the liquid line 116 can be implemented to create a closed loop path starting with the delivery vessel 102 and ending back at the delivery vessel 102.

Generally, the heating container 110 and the cooling container 112 can be implemented to heat and cool the depository vessel 106 and delivery vessel 102, respectively. In one embodiment, the heating container 110 and the cooling container 112 can both be filled with water. For instance, the depository vessel 106 can be adapted to be submerged into water of the heating container 110 and the delivery vessel 102 can be adapted to be submerged into water of the cooling container 112.

As shown in FIG. 1, the heating container 110 and the cooling container 112 can each have a drawer like structure, where the containers can be slid out and in from the rack 118. Typically, the heating container 110 can be kept around 45° C. to 50° C. and the cooling container 112 can be kept around 0° C. The water in the cooling container 112 can include ice in some instances. It is to be appreciated that other means of cooling the water in the cooling tray can be implemented.

Figure 4:
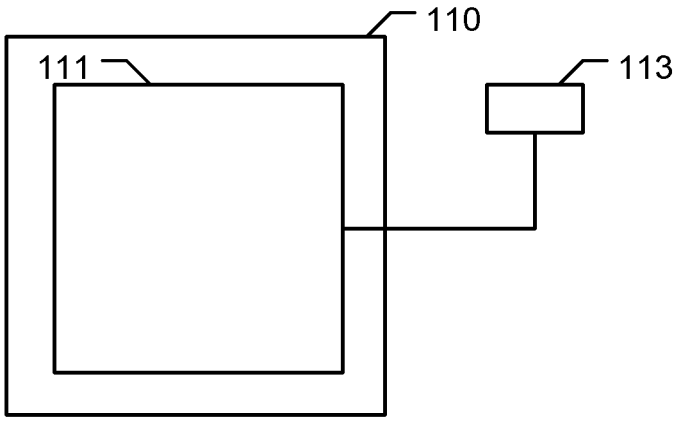
FIG. 4 is a block diagram of a bottom view of a heating container according to one embodiment of the present invention.

In one embodiment, the heating container 110 can include a heating element 111 adapted to heat the water in the heating container 110, as shown in FIG. 4. Typically, the heating container 110 can be filled with water that directly interfaces with the depository vessel 106. In one embodiment, the heating element 111 can be a heating blanket having a square area similar in size to a square area of a bottom of the heating container 110. To control the temperature of the water in the heating container 110, the heating element 111 can be set by a digital controller 113. The depository vessel 106 can generally be indirectly heated by the heating element 111.

Typically, the pump 108 can be a refrigerant recovery device. For example, the pump 108 can be a Caresaver Universal Refrigerant Recovery Unit manufactured by RDA Environmental Engineering Ltd. The pump 108 can be implemented to recover the solvent from the depository vessel 106 and returned to the delivery vessel 102.

The pressure relief valves 136, 174, 195 included with each of the vessels 102, 104, 106 can typically have the same release pressure. For instance, each of the pressure relief valves can have a pressure release of 150 psi. It is to be appreciated that each of the pressure relief valves 136, 174, 195 can have different pressure releases.

Example Embodiments of Components of the OBE System

In one example of the delivery vessel 102, the first bowl 124 and the second bowl 128 can have equal dimensions where the first bowl 124 can be inverted. For instance, the first bowl 124 and the second bowl 128 can each have a 12" diameter and a 5⅞" height. The pipe 126 can have a 12" diameter and a 7¼" height. The first bowl 124 can be welded to a top side of the pipe 126 and the second bowl 128 can be welded to a bottom side of the pipe 126.

The first shutoff valve 120 and the second shutoff valve 132 can each be ⅜", the first collar 122, the second collar 134, and the third collar 138 can each be ⅜", and the first quick connect 119 and the second quick connect 130 can each be ⅜". Typically, each of the collars 122, 134, 138 can be welded to the first bowl 124. The first shutoff valve 120, the second shutoff valve 132, and the pressure relieve valve 136 can each threadably couple to the respective collar. The first quick connect 119 and the second quick connect 130 can each threadably couple to the respective shutoff valve.

In one embodiment, the delivery vessel 102 can include the pressure relief valve 136. The pressure relief valve 136 can be implemented to release pressure in the delivery vessel 102 if the pressure goes above a prescribed range. For instance, the pressure relief valve can release pressure when a pressure inside the delivery vessel 102 goes above 150 psi. It is to be appreciated that the pressure relief valve can have a varying release pressure depending on a particular implementation.

In one example of the tapered vessel 104, the pipe 190 can have a 6" diameter and the conical pipe 192 can have a 6" diameter tapering down to 3". The first collar 182 and the third collar 199 can each be ⅜", the top plate 184 can have a 6" diameter, the clamp 186 can be 6", the flange 188 can be 6", the second collar 194 can be 1", the first quick connect 180 and the second quick connect 198 can each be ⅜". Generally, the first collar 182 and the third collar 199 can be directly coupled to the top plate 184. For instance, the collars 182, 199 can be welded to the top plate 184.

In a typical implementation, the first shutoff valve 181 can be threadably coupled to the first collar 182 and the T-connect 196 can be threadably coupled to the third collar 199. The first quick connect 180 can be threadably coupled to the first shutoff valve 181. The second shutoff valve 197 and the pressure relief valve 195 can each be threadably coupled to the T-connect 196. Typically, the second quick connect 198 can be threadably coupled to the second shutoff valve 197.

In one embodiment, the top plate 184 can include a manifold previously disclosed. The flange 188 can generally be a sanitary flange and welded to the pipe 190. Typically, a top side of the conical pipe 192 can be welded to a bottom side of the pipe 190. The second collar 194 can be welded to a bottom side of the conical pipe 192.

In one example of the depository vessel 106, each of the collars 148, 158, 166, and 172 can be welded to the top plate 150. The second shutoff valve 146 can be threadably coupled to the first collar 148, the first quick connect 160 can be threadably coupled to the second collar 158, the second shutoff valve 168 can be threadably coupled to the third collar 166, and the pressure relief valve 174 can be threadably coupled to the fourth collar 172.

Generally, the pipe 154 and the bowl 156 can have similar diameters. For instance, the pipe 154 can have a 12" diameter and a 5½" height and the bowl 156 can have a 12" diameter and a 7¼" height. The bowl 156 can be welded to a bottom side of the pipe 154. In one embodiment, the first flange 141 and the second flange 144 can be 1", the first shutoff valve 140 and the second shutoff valve 146 can each be 1", the first collar 148 can be 1", the top plate 150 can have a 12" diameter, the second collar 158, the third collar 166, and the fourth collar 172 can each be ⅜", the third shutoff valve 168 can be ⅜", the first quick connect 160 and the second quick connect 170 can be ⅜", and the first clamp 162 and the second clamp 164 can each be 1".

Generally, the third flange 152 can be welded to a top side of the pipe 154 and be adapted to couple the top plate 150 to the pipe 154. In one embodiment, each of the flanges 141, 144, 152 can be a sanitary flange. Typically, the top plate 150 can include the plurality of sight lenses 176.

In one embodiment, the depository vessel 106 can include the pressure relief valve 174. The pressure relief valve 174 can be implemented to release pressure in the depository vessel 106 if the pressure goes above a prescribed range.

It is to be appreciated that given dimensions in this disclosure are for illustrative purposes and are not meant to be limiting. Each of the components of the present invention can be scaled to various sizes without exceeding a scope of this disclosure. Alternative dimensions are anticipated and can be based on expected production yield.

A Method of Implementing the Organic Based Extractor System

Figure 5:
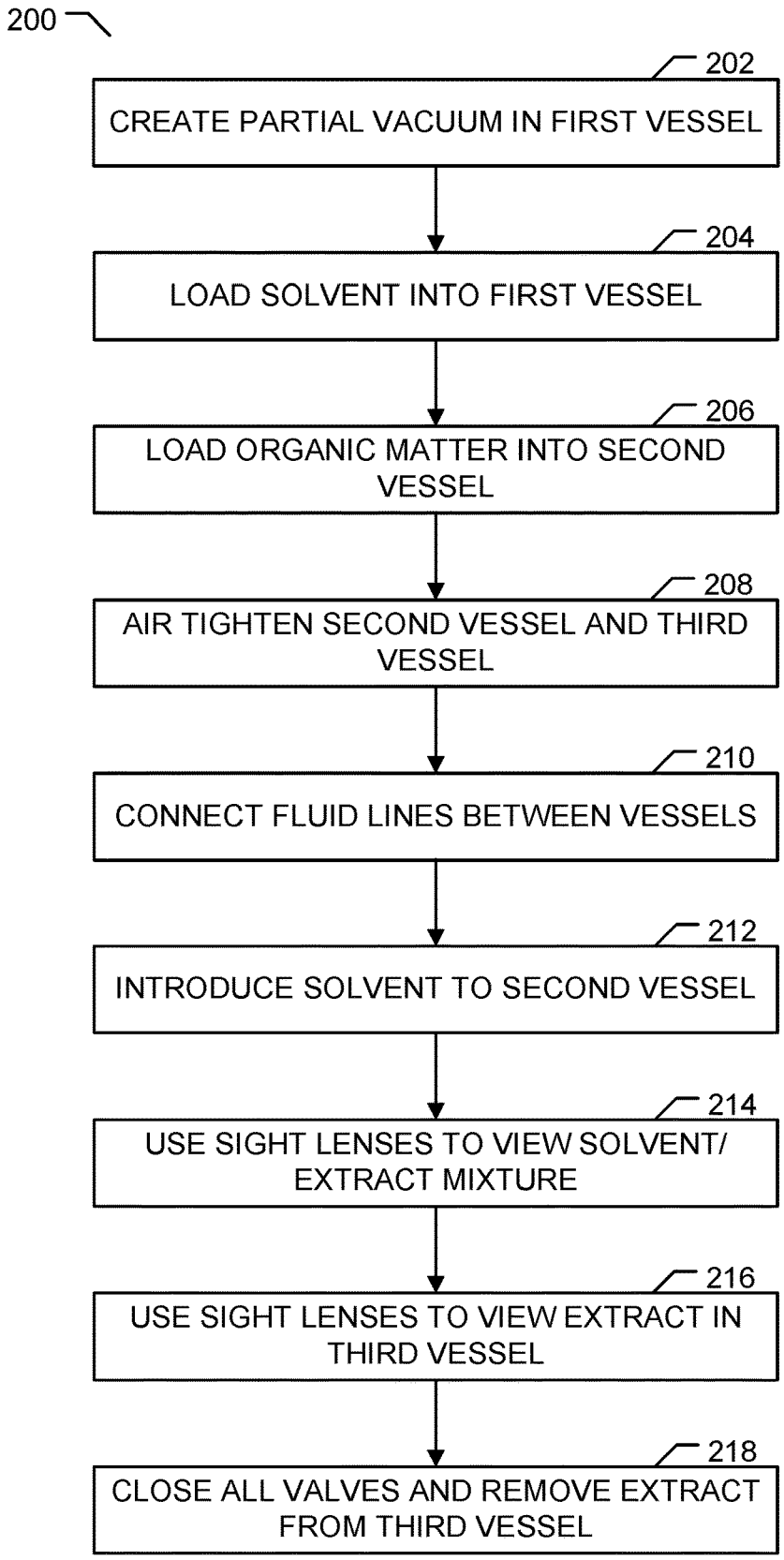
FIG. 5 is a flow chart of an extraction process according to one embodiment of the present invention.

Referring to FIG. 5, a flow chart of a method or process 200 is illustrated. Generally, the organic based extraction system 100 can be implemented in the process 200 to extract a compound from organic matter. For instance, the process 200 can be implemented to extract protein from soybeans.

In block 202, a partial vacuum can be created in the delivery vessel 102. For instance, the delivery vessel 102 can be connected to the pump 108 and all air can be removed from the delivery vessel 102.

Once a partial vacuum is created in the delivery vessel 102, the solvent can be loaded into the delivery vessel in block 204. For instance, butane can be loaded into the delivery vessel 102 via the liquid intake on the delivery vessel 102.

In block 206, the tapered vessel 104 can be loaded with organic matter. For instance, a plurality of soybeans can be loaded into the tapered vessel 104. In block 208, the tapered vessel 104 and the depository vessel 106 can be air tightened. Generally, the vessels 104, 106 can each be fluidly connected to the pump 108 to air tighten the vessels.

After the vessels 104, 106 are airtight, the gas lines 114 and the liquid line 116 can be connected in block 210. For instance, the liquid line 116 can be connected between the delivery vessel 102 and the tapered vessel 104 to allow the solvent to be moved from the delivery vessel 102 to the tapered vessel 104. The gas lines 114 can be connected between the depository vessel 106 and the pump 108, the pump 108 and the delivery vessel 102, and the depository vessel 106 and the tapered vessel 104.

In block 212, the solvent can be introduced to the organic matter in the tapered vessel 104. For instance, liquid line valves can be opened to allow the liquid solvent to flow from the delivery vessel 102 to the tapered vessel 104. The solvent can interact with the organic matter in the tapered vessel 104. For example, butane can act as a solvent and separate out proteins from the soybeans. As the solvent flows through the tapered vessel 104, extracted compounds from the organic matter and the solvent can move from the tapered vessel 104 to the depository vessel 106. In one embodiment, as the solvent is interacting with the organic matter, the depository vessel 106 can be heated by the heating apparatus 110 and the delivery vessel 102 can be cooled in the cooling tray 112. As the depository vessel 106 is heated, the solvent can transform from a liquid into a gas and move from the depository vessel 106 back to the delivery vessel 102. Cooling of the delivery vessel 102 can aid the solvent to re-liquefy inside the delivery vessel 102.

In block 214, a user can look through sight lenses included in the coupling between the tapered vessel 104 and the depository vessel 106. Generally, the user can look through the sight lenses to determine if an appropriate amount of solvent is being utilized. For example, the user can see a color of the extract and solvent mixture to determine if more or less solvent is needed.

In block 216, the user can look through the sight lenses included with the depository vessel 106. Generally, the user can shine a light through a first sight lens and look through a second sight lens. For example, the user can use the sight lenses to make sure the extracted compounds are not burning in the depository vessel 106. For instance, depending on the compound being extracted, the user can determine when the extract is burning based on a color of the extract. For example, if the extract is turning black, the user can determine that the extract is burning and lower a temperature of the heating container 110.

In block 218, all valves can be shut and the extract can be removed from the depository vessel 106. The process 200 can then return to block 206 and repeat.

It is to be appreciated that the above examples of extracting protein from soybeans is for illustrative purposes only and not meant to be limiting. Extracting proteins from soybeans is one example of solvent extraction capable by the present invention.

Alternative Embodiments and Variations

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

I claim:

1. A method of using an extraction system comprising:

providing an organic based extraction system, the system including:

a pump;

a first vessel, wherein the vessel is adapted to be pressurized so as to contain a solvent under pressure in a liquid state, wherein the first vessel is fluidly connected to the pump by a first line;

a second vessel fluidly connected to the first vessel by a second line, wherein the second vessel is adapted to contain organic matter and receive the solvent in a gaseous/vapor phase from the first vessel via the second line;

a third vessel fluidly connected to the first vessel via the pump, wherein the third vessel is fluidly connected to the second vessel, wherein the third vessel is fluidly connected to the pump by a third line; and a tube fluidly connecting the second vessel to the third vessel;

wherein the first vessel, the second vessel and the third vessel each includes a vapor and liquid shutoff valve located proximate a top of the second vessel and a dispersion manifold located proximate the top of the second vessel, wherein the dispersion manifold is located downstream of the shutoff valve, and wherein the dispersion manifold has a diameter substantially similar to a widest diameter of the second vessel;

filling the first vessel with a solvent;

filling the second vessel with organic matter;

transferring the solvent from the first vessel to the second vessel causing the solvent to interact with the organic matter and create a mixture comprising an extract-containing solvent;

monitoring the mixture in the tube;

monitoring the extract in the third vessel; and recovering the extract from the third vessel.

2. The method of claim 1, wherein each of the first vessel, the second vessel and the third vessel includes a pressure relief valve.

3. The method of claim 1, wherein the organic based extraction system further includes:

a first container adapted to cool the first vessel; and a second container adapted to heat the third vessel.

4. The method of claim 3, wherein the second container includes a heating element.

5. The method of claim 3, wherein each component of the organic based extraction system is assembled on a cart.

6. The method of claim 1, wherein the third vessel includes a burp line fluidly connected to the second vessel.

7. The method of claim 1, wherein monitoring comprises shining a light through one of a pair of sight lenses in the tube and viewing the mixture in the tube.

8. The method of claim 1, wherein each of the first vessel, the second vessel and the third vessel are manufactured from electropolished stainless steel.

9. The method of claim 1, wherein the solvent is butane.

10. The method of claim 9, wherein the organic matter is *cannabis*.

11. The method of claim 1, wherein the second vessel includes a filter.

12. An extraction system comprising:

a pump;

a first vessel adapted to contain a solvent under pressure, wherein the first vessel is vaporly connected to the pump;

a second vessel fluidly connected to the first vessel, wherein the second vessel is adapted to contain organic matter and receive the solvent, wherein the second vessel includes a shutoff valve and a manifold located downstream of the shutoff valve, wherein the manifold is adapted to distribute the solvent equally about the second vessel;

a third vessel fluidly connected to the first vessel, the second vessel, and the pump, wherein the third vessel includes a pair of sight lenses and a burp line fluidly connected to one of the first vessel and the second vessel; and a tube fluidly connecting the second vessel to the third vessel, wherein the tube includes at least one sight lens;

wherein a mixture including the solvent and an extract of the organic matter can be monitored through the at least one sight lens of the tube, and the extract of the organic matter in the third vessel can be monitored through one of the pair of sight lenses of the third vessel.

13. The method of claim 1, wherein the pump is a refrigerant recovery device.

14. The method of claim 1, wherein the organic based extraction system further includes a second container adapted to heat one of the vessels.

15. The method of claim 1, wherein each component of the organic based extraction system is assembled on a rack.

16. The method of claim 1, wherein one or more of the vessels includes a burp line adapted to release or equalize pressure in the vessels.

17. The method of claim 1, wherein monitoring comprises shining a light through one of the pair of sight lenses and viewing through one of a pair of sight lenses.

18. The method of claim 1, wherein monitoring the extract-containing solvent in the third vessel comprises viewing the extract-containing solvent in the third vessel through one of a plurality of sight lenses in the third vessel.

19. The method of claim 1, wherein monitoring comprises viewing through a sight lens.

20. The method of claim 1, wherein monitoring the mixture in the tube comprises viewing the mixture flowing through the tube through a sight lens, whereby a transparent mixture indicates that all of a targeted compound has been extracted from the organic matter.

21. The method of claim 1, wherein monitoring the mixture in the tube comprises viewing the mixture flowing through the tube through a sight lens, whereby a substantially opaque mixture is observed, and adding more solvent to the first vessel.

22. The method of claim 1, wherein monitoring is continuous monitoring.

23. The method of claim 1, wherein the solvent is an organic solvent that is a gas at room temperature.

24. The method of claim 1, wherein the solvent is an organic solvent that is a gas at room temperature.

25. The method of claim 1, wherein the manifold is adapted to spread the solvent evenly about a circumference of the second vessel, and equally across a diameter of the second vessel.

26. The method of claim 1, wherein at least one of the first vessel, the second vessel, and the third vessel includes a filter.

27. The method of claim 1, wherein the system further comprises:

heating the second vessel using a heating container kept at a temperature of 45° C. to 50° C.; and cooling the first vessel using a cooling container kept at a temperature of about 0° C.

28. An organic based extraction system, the system including:

a pump;

a first vessel, wherein the vessel is adapted to be pressurized so as to contain a solvent under pressure in a liquid state, wherein the first vessel is fluidly connected to the pump by a first line;

a second vessel fluidly connected to the first vessel by a second line, wherein the second vessel is adapted to contain organic matter and receive the solvent in a gaseous/vapor phase from the first vessel via the second line;

a third vessel fluidly connected to the first vessel via the pump, wherein the third vessel is fluidly connected to the second vessel, wherein the third vessel is fluidly connected to the pump by a third line; and a tube fluidly connecting the second vessel to the third vessel;

wherein the first vessel, the second vessel and the third vessel each includes a vapor and liquid shutoff valve located proximate a top of the second vessel and a dispersion manifold located proximate the top of the second vessel, wherein the dispersion manifold is located downstream of the shutoff valve, and wherein the dispersion manifold has a diameter substantially similar to a widest diameter of the second vessel.

29. An extraction system comprising:

a pump adapted for refrigerant recovery;

a first vessel adapted to contain a solvent under pressure, wherein the first vessel is fluidly connected to the pump;

a second vessel fluidly connected to the first vessel and adapted to contain organic matter and receive solvent, the second vessel comprising:

a lid, a pipe having a tapered end, a manifold adapted to spread solvent evenly about a circumference of the pipe, and a clamp adapted to couple the lid to a top of the pipe with the manifold located between a top plate of the manifold and a top of the pipe;

a third vessel fluidly connected to the first vessel and the second vessel, wherein the third vessel is vaporly connected to the pump, wherein the third vessel comprises a pair of sight lenses and a burp line fluidly connected to the first vessel or the second vessel, wherein the burp line is adapted to equalize pressure between the second vessel and the third vessel; and a tube fluidly connecting the second vessel to the third vessel, wherein the tube comprises at least one sight lens.

* * * * *